US005274393A

United States Patent [19]

Scott

[11] Patent Number: 5,274,393

[45] Date of Patent: Dec. 28, 1993

[54] ADJUSTABLE HELICAL ANTENNA FOR A VHF RADIO

[75] Inventor: Kenneth R. Scott, Lawrence, Kans.

[73] Assignee: Allied-Signal Inc., Morris Township, Morris County, N.J.

[21] Appl. No.: 763,699

[22] Filed: Sep. 23, 1991

[51] Int. Cl.[5] ..... H01Q 1/36; H01Q 11/12

[52] U.S. Cl. ..... 343/895; 343/702; 343/723; 343/906; 343/894

[58] Field of Search ..... 343/712, 715, 894, 895, 343/900, 745, 749, 750, 906, 723

[56] References Cited

U.S. PATENT DOCUMENTS

| | | | |
|---|---|---|---|
| 2,214,685 | 9/1940 | Stone, Jr. | 343/894 |
| 2,781,514 | 2/1957 | Sichak et al. | 343/895 |
| 3,116,691 | 1/1964 | Tatel et al. | 343/702 |
| 3,143,331 | 8/1964 | Corey | 343/702 |
| 3,226,725 | 12/1965 | Ritchie et al. | 343/750 |
| 3,300,749 | 1/1967 | Lombardi | 439/10 |
| 3,523,251 | 8/1970 | Halstead | 343/895 |
| 3,737,912 | 6/1973 | Cribb | 343/895 |
| 3,818,488 | 6/1974 | Majkrzak et al. | 343/709 |
| 4,048,638 | 9/1977 | Cejka | 343/894 |
| 4,435,713 | 3/1984 | Gasparaitis et al. | 343/895 |
| 4,620,194 | 10/1986 | Bel Moratalla | 343/750 |
| 4,725,395 | 2/1988 | Gasparaitis et al. | 343/895 |
| 4,725,845 | 2/1988 | Phillips | 343/895 |

FOREIGN PATENT DOCUMENTS 0370715 5/1990 European Pat. Off. .

*Primary Examiner*—Michael C. Wimer
*Assistant Examiner*—Tan Ho
*Attorney, Agent, or Firm*—Howard G. Massung

[57] ABSTRACT

A VHF radio (10) which includes an adjustable antenna (20) formed from a component (28) shaped like an open helical compression spring which engages and can be screwed into a metal supporting collar (40) for tuning the antenna (20). An elongated plastic or rubber cylindrical member (30) is connected to the metal collar and surrounds at least a portion of the helical member (28). An end cap (32) is provided for closing the other end of the cylindrical member (30).

6 Claims, 3 Drawing Sheets

ADJUSTABLE HELICAL ANTENNA FOR A VHF RADIO

BACKGROUND OF THE INVENTION

1. Field of the Invention

This invention relates to VHF radios and more specifically to a portable VHF transceiver having an adjustable antenna.

2. Description of the Prior Art

VHF transceivers which are portable and used in land mobile services normally include a removable antenna which is normally covered by a flexible rubber or plastic material. The antenna must be tuned to the radio operating frequency to get the maximum performance from the radio. The antennas include a threaded male connector which engages a female connector or RF connector such as BNC, TNC, SMA or the like which is disposed in the radio housing. In the prior art VHF transceivers which operate in the 136 MHz to 174 MHz band using frequency modulation the antennas are sold separately and pretuned to the middle of the band or to a specific frequency by cutting to length.

Helical coil antennas are tuned by cutting the antenna length to the desired frequency. This can be done by two different methods. The first method involves the use of a cutting chart on which the antenna is placed for measuring, marked and cut to length. The other method is to us test equipment in the shop or laboratory and cut the antenna by approximations until the desired adjustment is made. In both cases, there is risk of the antenna being cut too short. If the antenna is cut too short, then a new one has to be recut. Both of these methods are impractical in the field.

SUMMARY OF THE INVENTION

The present invention teaches a VHF radio which includes an adjustable antenna formed from an elongated helical component, shaped like an open helical compression spring, which engages and can be screwed into a metal supporting collar for adjustment. The metal collar includes an elongated opening which can have internal threads or be formed with a cross-pin extending there through which engages one end of the helical-shaped member. An elongated plastic or rubber tubular member which engages the metal housing is provided around at least a portion of the helical member. An end cap is provided for the free end of the tubular member to cover the adjustable helical member. The tubular member can be formed from more than one piece and can include frequency calibration marks which can be interpreted for different adjustments of the helical member.

The disclosed adjustable helical antenna design provides an antenna that can be easily tuned in the field and effectively replaces several precut antennas with one adjustable one.

BRIEF DESCRIPTION OF THE DRAWINGS

For a better understanding of the invention reference may be had to the preferred embodiments exemplary of the invention shown in the accompanying drawings in which.

DETAILED DESCRIPTION OF THE PREFERRED EMBODIMENTS

Figure 9:
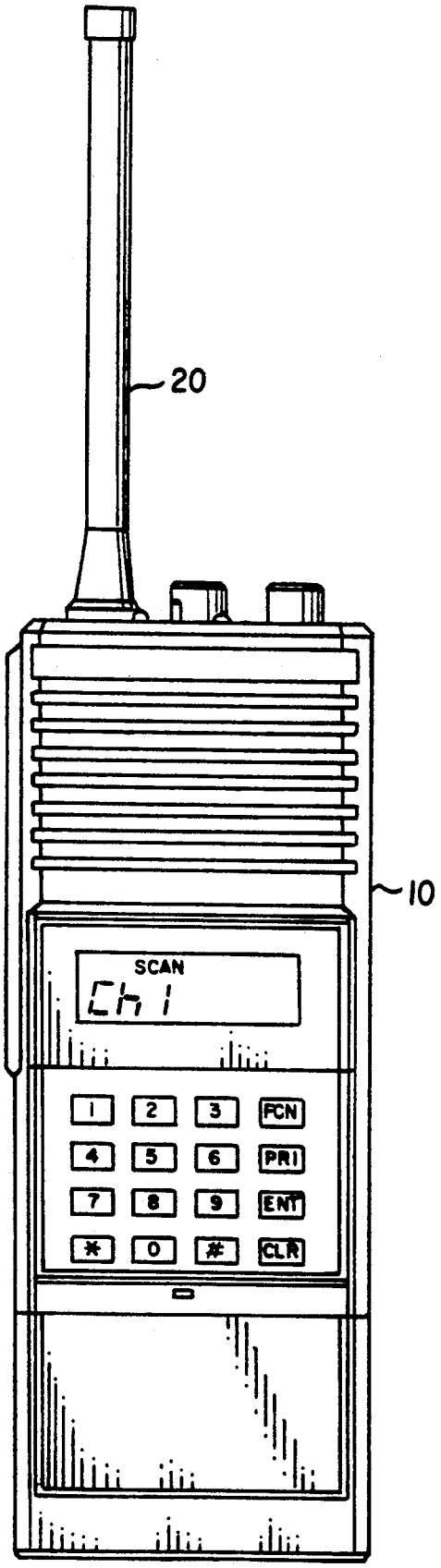
FIG. 9 is a view of a portable hand-held radio on which the adjustable helical antenna can be used.

Referring now to the drawings and FIG. 9 in particular, there is shown a VHF portable transceiver 10 utilizing an adjustable helical antenna 20 according to the teaching of the present invention. Radio 10 can be a VHF transceiver operating in the 136 MHZ to 174 MHz band using frequency modulation, such as the LPH or the EPH series radios manufactured by Bendix/King Mobile Communications Division, Lawrence, Kans. The disclosed adjustable helical antenna 20, according to the teaching of the present invention, is particularly suitable for use with these radios.

Figure 2:
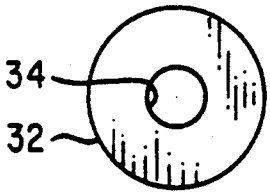
FIG. 2 is a top view of the antenna shown in FIG. 1.
Figure 3:
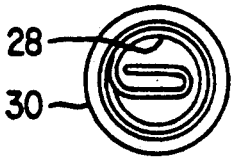
FIG. 3 is a top view of the antenna shown in FIG. 1 with the end cap removed.
Figure 1:
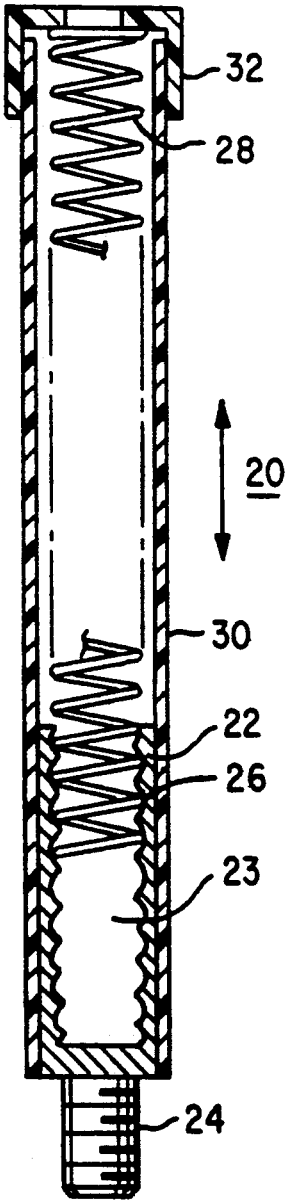
FIG. 1 is a side view partially in section showing an adjustable helical antenna according to the present invention.

Referring now to FIG. 1, there is shown a helical antenna 20 according to the present invention. Adjustable antenna 20 includes a metal collar member 22 having an external stud or threaded portion 24 which engages an internal threaded opening formed in the housing of radio 10 to attach antenna 20 to radio 10. Collar member 22 includes an elongated opening 23 which has an internal threaded portion 26. An adjustable member 28 formed in the shape of an open helical compression spring fits snugly into opening 23 and engages the internal threads 26 of collar 22. A rubber or plastic hollow, elongated cylindrical member 30 is attached to threaded collar 22 and surrounds the helical-shaped member 28. An end cap 32 is provided on the free end of cylindrical member 30. End cap 32 can have an opening 34 formed therein to admit a screwdriver or other adjusting tool to engage, turn and adjust the length of the helical member 28 which extends from threaded collar 26. Alternately, end cap 32 can be formed without an opening 34. End cap 32 would then be removed when the length of the helical compression spring member 28 which extends from collar 22 is adjusted. The end of helical member 28 which extends from collar 22 can be bent as shown in FIG. 3 to receive a screwdriver for easy adjustments.

Figure 5:
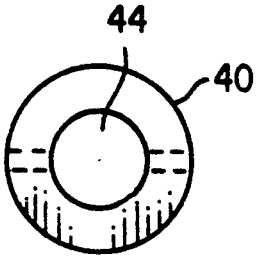
FIG. 5 is a top view of the collar shown in FIG. 4.
Figure 4:
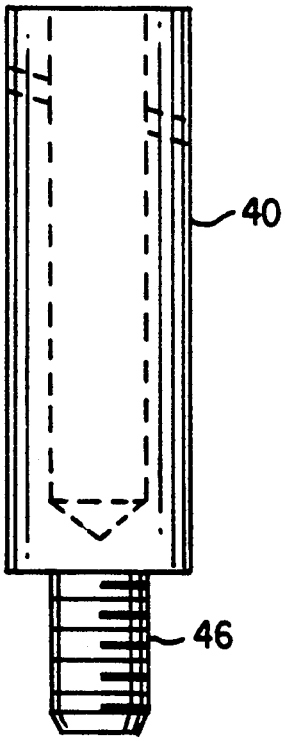
FIG. 4 is a side view of another embodiment of the metal collar which connects to the VHF radio.
Figure 6:
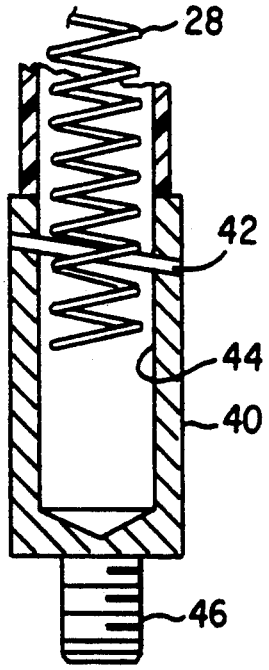
FIG. 6 is a view showing the metal collar member engaging the helical-shaped member.

Referring now to FIGS. 4, 5 and 6 there is shown an alternate embodiment of the invention using a different construction for the metal collar member 22. Metal collar 40 shown in these figures does not include an internal threaded portion 22, but rather has a pin 42 which extends at a slight upward angle across the elongated opening 44 formed in collar 40. The helical member 28 engages the side walls of opening 44 and is threaded around pin 42. Thus as helical member 28 is rotated it move longitudinally and the length of helical member 28 which extends from collar 40 can be adjusted. Collar 40 includes a threaded stud 46 for connecting to radio 10.

Figure 7:
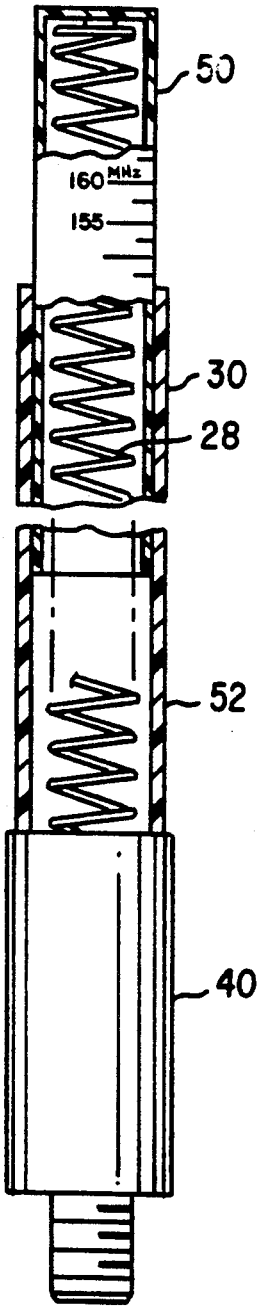
FIG. 7 is a side view of another embodiment of the invention wherein frequency calibration marks are formed on the plastic housing.

Referring to FIG. 7 there is shown an embodiment of the invention wherein one end of helical member 28 is adjustably received in collar 40 and the other end is secured to the inside of an inner cylindrical member 50. Inner cylindrical member 50 fits partially within an outer cylindrical member 52. Outer cylindrical member 52 attaches to and extends from collar 40. Inner cylindrical member 50 includes calibration marks which can be read with respect to the free end of member 52 to show the frequency to which the antenna is tuned. A locking means can provide between inner cylinder 50 and outer cylinder 30 for locking the antenna 10 at the desired tuned frequency.

Figure 8:
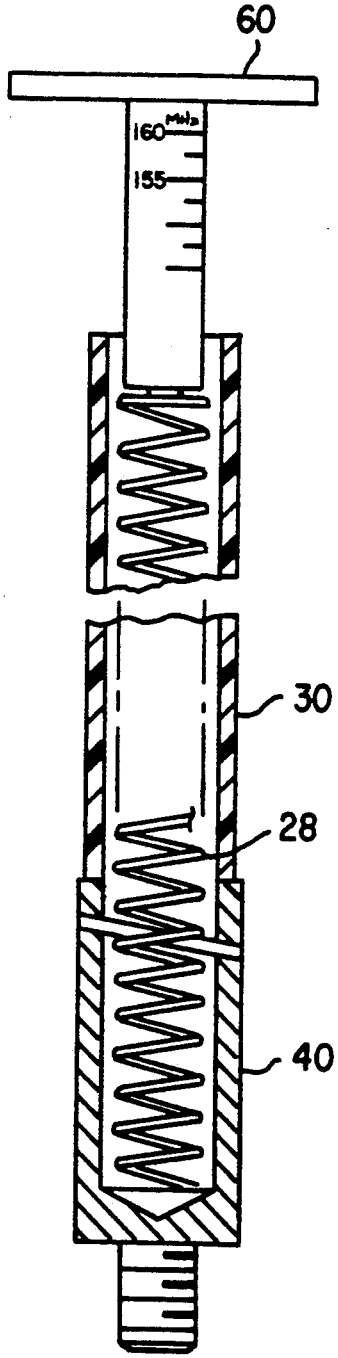
FIG. 8 is a side view, partially in section, showing a calibrated tuning tool for adjusting the helical antenna.

Referring now to FIG. 8, there is shown a tuning tool 60, including frequency calibration marks, which can be used to engage and adjust helical member 28. Frequency calibration marks are formed on the side of tuning tool 60. Tuning tool 60 includes a screwdriver shaped tip which engages the free end of helical member 28. Rotating tuning tool 60 increases or decreases the length of the helical member 28 which extends from collar 40. Collar 40 includes a cross pin which engages helical member 28 causing helical member 28 to move longitudinally with respect to collar 40 as helical member 28 is rotated. Collar 40 includes a threaded stud or other connector that is appropriate for the VHF radio to which the antenna will be connected. After the antenna is tuned to the desired frequency the tuning tool is removed and an end cap is put on the open end 32 of tubular member 30.

I claim:

1. A portable VHF radio having a connector for engaging an adjustable antenna, said adjustable antenna comprising:

a metal collar member having an elongated inner opening and an outer connector portion for engaging the antenna connector on the VHF radio;

a helical-shaped member formed to have a portion which fits within the inner opening of said metal collar;

adjusting means disposed within said inner opening for engaging said helical-shaped member to adjust the length of said helical-shaped member which extends from said metal collar as said helical-shaped member is rotated; and, said adjusting means comprises a pin which extends across the elongated inner opening of said metal collar.

2. Apparatus as claimed in claim 1 comprising a first flexible tubular member connected to said metal collar and surrounding at least a portion of said helical member.

3. Apparatus as claimed in claim 3 comprising a second flexible tubular member having a telescopic fit with respect to said first tubular member and being connected to said helical member to move longitudinally with said helical member as said helical member is rotated.

4. Apparatus as claimed in claim 3 comprising frequency calibration marks formed on said second flexible tubular member.

5. A radio having an adjustable antenna comprising:

a collar member connected to the radio and having an elongated inner opening;

an elongated helical shaped member having one end disposed in the inner opening of said collar member;

engaging means disposed for engaging and moving said helical shaped member longitudinally with respect to said collar member as said helical shaped member is rotated thereby turning the antenna; and, said engaging means comprises a pin which is disposed within and extends across the inner opening of said collar member.

6. A portable VHF radio having a connector for engaging an adjustable antenna, said adjustable antenna comprising:

a metal collar member having an elongated inner opening and an outer connector portion for engaging the antenna connector on the VHF radio;

an open helical-shaped member formed to have a portion which fits within the inner opening of said metal collar;

adjusting means disposed within said inner opening for engaging and moving longitudinal said open helical-shaped member as said open helical-shaped member is rotated to adjust the length of said open helical-shaped member which extends from said metal collar; and, said adjusting means comprises internal threads formed on the inside of the elongated inner opening of said metal collar for engaging the outside of said open helical member.

* * * * *